US005200062A

United States Patent [19]

Poirier et al.

[11] Patent Number: 5,200,062

[45] Date of Patent: Apr. 6, 1993

[54] PROCESS FOR REMOVING ELEMENTAL SULFUR FROM FLUIDS

[75] Inventors: Marc-André Poirier; John B. Gilbert, both of Sarnia, Canada

[73] Assignee: Exxon Research and Engineering Company, Florham Park, N.J.

[21] Appl. No.: 715,957

[22] Filed: Jun. 17, 1991

[51] Int. Cl.[5] ..... C10G 29/20

[52] U.S. Cl. ..... 208/236; 208/208 R; 208/237

[58] Field of Search ..... 208/208 R, 206, 207, 208/230, 236, 237

[56] References Cited

U.S. PATENT DOCUMENTS 3,617,529 11/1971 Thompson et al. ..... 208/230

4,149,966 4/1979 O'Donnell et al. ..... 208/237

4,156,641 5/1979 Frame ..... 208/207

4,260,479 4/1981 Frame ..... 208/207

4,923,596 5/1990 Bricker et al. ..... 208/207

*Primary Examiner*—Theodore Morris

*Assistant Examiner*—Walter D. Griffin

*Attorney, Agent, or Firm*—Roy J. Ott

[57] ABSTRACT

A process for removing elemental sulfur from fluids such as refined petroleum products transported through pipelines for the transportation of sour hydrocarbon streams. The fluids are contacted with a soluble quaternary ammonium hydroxide and preferably an organo mercaptan and alcohol to convert the elemental sulfur to a soluble polysulfide product which is substantially non-corrosive.

11 Claims, No Drawings

PROCESS FOR REMOVING ELEMENTAL SULFUR FROM FLUIDS

BACKGROUND OF THE INVENTION

Field of the Invention

This invention relates to a process for removing elemental sulfur from fluids, particularly fuels such as gasoline transported in a pipeline for the transportation of sour hydrocarbon streams. The fluids are preferably contacted with a quaternary ammonium hydroxide, alcohol and a mercaptan to convert the sulfur to soluble, relatively non-corrosive polysulfides.

Description of Related Art

It is well known that elemental sulfur and other sulfur compounds contained in hydrocarbon streams is corrosive and damaging to metal equipment, particularly copper and copper alloys. Sulfur and sulfur compounds may be present in varying concentrations in the refined fuels and additional contamination may take place as a consequence of transporting the refined fuel through pipelines containing sulfur contaminants resulting from the transportation of sour hydrocarbon streams such as petroleum crudes. The sulfur has a particularly corrosive effect on equipment such as brass valves, gauges, and in-tank fuel pump copper commutators.

Various techniques have been reported for removing elemental sulfur from petroleum products. For example, U.S. Pat. No. 4,149,966 discloses a method for removing elemental sulfur from refined hydrocarbon fuels by adding an organo-mercaptan compound and a copper compound capable of forming a soluble complex with said mercaptan and said sulfur and contacting said fuel with an adsorbent material to remove the resulting copper complex and substantially all the elemental sulfur.

U.S. Pat. No. 4,908,122 discloses a process for sweetening a sour hydrocarbon fraction containing mercaptans by contacting the hydrocarbon fraction in the presence of an oxidizing agent with a catalytic composite, ammonium hydroxide and a quaternary ammonium salt other than hydroxide.

U.S. Pat. No. 3,185,641 describes a method for removing elemental sulfur from a liquid hydrocarbon which comprises contacting with solid sodium hydroxide a hydrocarbon stream having dissolved therein at least 7.6 parts by weight of water per part of sulfur contained therein to yield both a hydrocarbon phase and an aqueous phase. The method is claimed to be effective and convenient for treating gasoline containing from trace to more than 25 ppm sulfur employing temperatures as high as about 140° F. (60° C.).

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

SUMMARY OF THE INVENTION

The present invention provides a process for removing elemental sulfur from fluids such as hydrocarbon fuels, fuel blending components such as octane improvers, or solvents transported in a pipeline for the transportation of sour hydrocarbon fluids, comprising contacting the sulfur-containing fluid with a soluble quaternary ammonium hydroxide to form non-corrosive soluble sulfur complexes. In a preferred embodiment, the fluid is also contacted with an alcohol and an organo mercaptan. The organo mercaptan may be replaced in part or whole by a sulfide. Elemental sulfur removal is enhanced by the alcohol which acts as a phase transfer or solubilizing agent and by the mercaptan or sulfide which forms a soluble sulfur complex with the elemental sulfur, thereby accelerating its removal.

DETAILED DESCRIPTION OF THE INVENTION

The quaternary ammonium hydroxides useful in the present invention include a wide variety of compounds having the general formula:

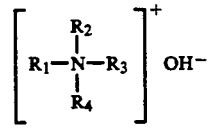

wherein $R_1$, $R_2$, $R_3$ and $R_4$ are each independently alkyl, hydroxyalkyl, alkoxyalkyl, aryl, or hydroxy aryl containing 1 to 16 carbon atoms. The groups $R_1$, $R_2$, $R_3$ and $R_4$ are selected so that the quaternary ammonium hydroxide is soluble in the fluid to be treated. Preferably $R_1$, $R_2$, $R_3$ and $R_4$ are each an alkyl group and at least one, more preferably two or more, of the groups $R_1$, $R_2$, $R_3$ and $R_4$ is a straight chain alkyl group containing 6 to 10 carbon atoms.

Specific examples of alkyl groups containing from one to 16 carbon atoms include methyl, ethyl, propyl, butyl, pentyl, hexyl, heptyl, octyl, nonyl, decyl, dodecyl and tetradecyl groups. $R_1$, $R_2$, $R_3$ and $R_4$ also may be hydroxyalkyl groups such as hydroxymethyl, hydroxyethyl and various isomers of hydroxypropyl, hydroxybutyl, hydroxypentyl, etc. Specific examples of alkoxyalkyl groups include methoxymethyl, ethoxymethyl, ethoxyethyl, butoxymethyl, butoxybutyl, etc. Examples of various aryl and hydroxyaryl groups include phenyl, benzyl, and equivalent groups wherein benzene rings have been substituted with one or more hydroxy groups.

Examples of quaternary ammonium hydroxides which can be used in the invention include trimethyl octyl ammonium hydroxide, trioctyl methyl ammonium hydroxide, tetrahexyl ammonium hydroxide, tetraoctyl ammonium hydroxide, phenyl triethyl ammonium hydroxide and the like. The quaternary ammonium hydroxides are usually employed as aqueous or alcohol, preferably the later, solutions. Typically, the quaternary ammonium hydroxide will be employed as an alcohol solution containing 10–40 weight percent of the quaternary ammonium hydroxide.

The organo mercaptans useful in the present invention include a wide variety of compounds having the general formula RSH, where R represents an organic radical which may be alkyl, alkenyl, cycloalkyl, cycloalkenyl, aryl or arylalkyl having from 1 to about 16 carbon atoms. Thus, the radical may be, for example, methyl, ethyl, n-propyl, i-propyl, n-butyl, i-butyl, sec-butyl, t-butyl, amyl, n-octyl, decyl, dodecyl, octadecyl, phenyl, benzyl and the like. Most preferably, RSH is an alkyl mercaptan containing 2 to 5 carbon atoms.

The organo mercaptan may be replaced in part or whole by a sulfide such as $K_2S$, NaHS, $Li_2S$ and the like.

Alcohols are preferably employed in the invention to promote solubility of the quaternary ammonium hydroxides and mercaptan. Useful alcohols include, among others, the alkanols containing 1 to 10 carbon atoms, more preferably 1 to 4 carbon atoms. Other alcohols include glycols such as ethylene or propylene, glycol capable of solubilizing the said quaternary ammonium hydroxides. Examples of preferred alcohols include methanol, ethanol, n-propanol, i-propanol, n-butanol, i-butanol and t-butanol.

The fluids which are treated in accordance with the invention include fluids containing elemental sulfur where the elemental sulfur is detrimental to the performance of the fluid. The invention is particularly applicable to those liquid products which have become contaminated with elemental sulfur as a result of being transported in a pipeline previously used to transport sour hydrocarbon streams such as petroleum crudes.

The fluids treated in accordance with the invention include a wide variety of petroleum fuels and particularly refined hydrocarbon fuels such as gasoline, jet fuel, diesel fuel and kerosene.

Other fluids include ethers used to improve the octane ratings of gasoline. These ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, isopropyl tertiary-amyl ether. Mixtures of these ethers and hydrocarbons may also be treated in accordance with the invention.

In general, the process of the invention involves the addition to the fluid of effective amounts of the quaternary ammonium hydroxide so that it reacts with the elemental sulfur to form a soluble polysulfide product. Conversion of elemental sulfur is enhanced by the addition of the mercaptan which facilitates the conversion of elemental sulfur by reaction with the sulfur to also form a polysulfide product. Alcohol addition is also preferred since it serves to solubilize the quaternary ammonium hydroxide and the organo mercaptan.

The treating conditions which may be used to carry out the present invention are conventional. Contacting of the fluid to be treated is effected at ambient temperature conditions, although higher temperatures up to 100° C. or higher may be employed. Substantially atmospheric pressures are suitable, although pressures may, for example, range up to 1000 psig. Contact times may vary widely depending on the fluid to be treated, the amount of elemental sulfur therein and the treating materials used. The contact time will be chosen to effect the desired degree of elemental sulfur conversion. In most cases, the reaction proceeds relatively fast, usually within a few minutes. Contact times ranging from 30 seconds to a few hours will usually be adequate.

The polysulfide reaction products are usually soluble and essentially non-corrosive so that the use of adsorbents and/or filtration is usually unnecessary. Insoluble products will form in those cases where low molecular weight alkyl ammonium hydroxides, such as tetra methyl ammonium hydroxide, are used, but it is preferred that the quaternary ammonium hydroxide be chosen to produce a soluble reaction product. Usually the quaternary ammonium hydroxide is added to the fluid as a solution in alcohol, and the mercaptan is added separately.

The reactants may be dispersed within the fluid to be treated using any suitable mixing device which will provide maximum mixing with the fluid. The process is particularly adapted for continuous operation wherein a static mixer is employed and the reactants are injected into a moving flow of the fluid prior to entry into the static mixer. Residence time in the mixer should be sufficient to maximize the formation of polysulfide reaction product.

The amount of quaternary ammonium hydroxide used in accordance with the invention generally ranges from about 0.2 to 1.0 moles, preferably from about 0.3 to 0.5 moles, of quaternary ammonium hydroxide per mole of elemental sulfur present in the fluid to be treated.

The amount of organo mercaptan used in accordance with the invention generally ranges from 0 to about 2 moles, preferably from about 0.5 to 1.0 moles, of organo mercaptan per mole of elemental sulfur present in the fluid to be treated.

As mentioned, the alcohol serves as solubilizing agent. The amount of alcohol present may therefore vary within wide limits. Typically, the quaternary ammonium hydroxide is added as an alcohol solution containing about 10 to 40 wt. %, preferably 20 to 30 wt. % of the quaternary ammonium hydroxide.

Fluids containing quantities of elemental sulfur as high as 100 mg, or higher, sulfur per liter, more usually from about 10 to about 60 mg per liter, can be effectively treated in accordance with this invention to reduce the sulfur contamination to about 5 mg sulfur per liter or lower.

The following examples are illustrative of the invention.

EXAMPLE 1

Into a stirred beaker were added 100 ml of a pipelined gasoline and 50 mg of a solution of trioctyl methyl ammonium hydroxide in isopropanol (11.3 wt. % trioctyl methyl ammonium hydroxide). The gasoline contained 44 mg/L of elemental sulfur (Mercury Number Method; UOP Method 286-59) and had a copper corrosion of 4 b (ASTM D-130).

The mixture was stirred at room temperature for 24 hours. No undissolved reaction products or reactants were observed and the resulting gasoline mixture has an elemental sulfur content of 2 mg/L and a copper corrosion of 1*a*.

EXAMPLE 2

Into a stirred beaker were added 100 ml of a refined oil obtained before Merox treatment and having a boiling point in the range from 140° to 260° C., and 50 mg of the trioctyl methyl ammonium hydroxide solution of Example 1. The oil had a mercaptan level (ASTM D3227) of 68 weight parts per million (wppm). The mixture was stirred at room temperature for 24 hours and the resultant mixture had a mercaptan level of 12 wppm.

EXAMPLE 3

Into a stirred beaker were added 100 ml of the pipelined gasoline of Example 1 and 35 mg of a solution of tetrabutyl ammonium hydroxide and methanol (1 M solution in methanol). After stirring at room temperature for 24 hours, followed by decantation of methanol, the elemental sulfur and cooper corrosivity levels of the treated gasoline were 2 mg/L and 1*a*, respectively.

EXAMPLE 4

Into a stirred beaker were added 1000 ml of pipelined gasoline, 62 mg of n-propyl mercaptan and 1.22 ml (314 mg) of a 30% solution of trioctyl methyl ammonium hydroxide in methanol. After 30 minutes of stirring, the elemental sulphur content in the gasoline was reduced from 52 to 2 mg/L.

EXAMPLE 5

Into a stirred beaker were added 1000 ml of pipelined gasoline, 54 mg of n-propyl mercaptan and 1.05 ml (271 mg) of a 30% solution of trioctyl methyl ammonium hydroxide in methanol. After 30 minutes of stirring, the elemental sulphur content in the gasoline was reduced from 45 to 2 mg/L.

What is claimed is:

1. A process for reducing the elemental sulfur content of a liquid fluid containing same comprising contacting said fluid with an effective amount of quaternary ammonium hydroxide soluble in said fluid and having the general formula:

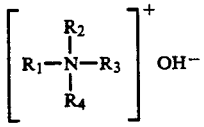

wherein $R_1$, $R_2$, $R_3$ and $R_4$ are each independently alkyl, hydroxyalkyl, alkoxyalkyl, aryl or hydroxyaryl containing 1 to 16 carbon atoms to convert the elemental sulfur to a soluble polysulfide product.

2. The process of claim 1 wherein the fluid is additionally contacted with an alcohol and an organo mercaptan soluble in said fluid.

3. The process of claim 2 wherein $R_1$, $R_2$, $R_3$ and $R_4$ are each an alkyl group.

4. The process of claim 1 wherein the fluid is additionally contacted with an alcohol and a sulfide.

5. The process of claim 4 wherein said fluid is a refined petroleum fuel which has been transported through a pipeline used to transport a sour hydrocarbon stream.

6. The process of claim 5 wherein at least one of the groups $R_1$, $R_2$, $R_3$ and $R_4$ contains 6 to 10 carbon atoms and the alcohol contains 1 to 4 carbon atoms.

7. The process of claim 6 wherein the quaternary ammonium hydroxide is trioctyl methyl ammonium hydroxide and the alcohol is methanol, ethanol or isopropanol.

8. A process for reducing the corrosivity of a hydrocarbon fuel by removing elemental sulfur resulting from the transportation of said fuel through a pipeline used to transport sour hydrocarbon fluids, which process comprises contacting said fuel with effective amounts of (a) a quaternary ammonium hydroxide soluble in said fuel and having the general formula:

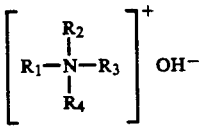

wherein $R_1$, $R_2$, $R_3$ and $R_4$ are each independently alkyl, hydroxyalkyl, alkoxyalkyl, aryl or hydroxyaryl containing 1 to 16 carbon atoms to convert the elemental sulfur to a soluble polysulfide product;

(b) an alcohol; and (c) an organo mercaptan soluble in said fuel to form a substantially non-corrosive, fuel soluble polysulfide product.

9. The process of claim 8 wherein $R_1$, $R_2$, $R_3$ and $R_4$ are each an alkyl group and at least one of $R_1$, $R_2$, $R_3$ and $R_4$ contains 6 to 10 carbon atoms and wherein the alcohol contains 1 to 4 carbon atoms.

10. The process of claim 9 wherein the organo mercaptan is an alkyl mercaptan containing 2 to 5 carbon atoms.

11. The process of claim 10 wherein the sulfur content of said fuel is reduced to 3 mg elemental sulfur per liter or lower.

* * * * *